US011745836B1

(12) United States Patent
Tingey

(10) Patent No.: US 11,745,836 B1
(45) Date of Patent: Sep. 5, 2023

(54) INFLATABLE KAYAKS WITH NON-PLANAR HULLS

(71) Applicant: ALPACKA RAFT LLC, Mancos, CO (US)

(72) Inventor: Sheri Lynn Tingey, Mancos, CO (US)

(73) Assignee: ALPACKA RAFT LLC, Mancos, CO (US)

( * ) Notice: Subject to any disclaimer, the term of this patent is extended or adjusted under 35 U.S.C. 154(b) by 0 days.

(21) Appl. No.: 18/189,715

(22) Filed: Mar. 24, 2023

Related U.S. Application Data

(60) Provisional application No. 63/330,620, filed on Apr. 13, 2022.

(51) Int. Cl.
*B63B 34/22* (2020.01)
*B63B 34/23* (2020.01)

(52) U.S. Cl.
CPC ..... *B63B 34/22* (2020.02); *B63B 34/23* (2020.02)

(58) Field of Classification Search
CPC ..... B63B 34/20; B63B 34/21; B63B 34/22; B63B 34/23
USPC ..... 114/343, 345, 347
See application file for complete search history.

(56) References Cited

U.S. PATENT DOCUMENTS

| | | | | |
|---|---|---|---|---|
| 4,031,580 | A * | 6/1977 | Neumann | B63B 34/22 114/345 |
| 7,021,233 | B2 * | 4/2006 | Hall | B63B 34/23 114/345 |
| 7,185,600 | B2 * | 3/2007 | Toussi | B63B 34/26 114/345 |
| 8,438,986 | B2 * | 5/2013 | Haller | B63B 34/22 114/354 |
| 9,452,809 | B2 * | 9/2016 | Hoge, Jr. | B63B 34/22 |
| 9,637,201 | B2 * | 5/2017 | Hoge, Jr. | B63B 34/22 |

* cited by examiner

*Primary Examiner* — Daniel V Venne
(74) *Attorney, Agent, or Firm* — Celia H. Leber; Leber IP Law

(57) ABSTRACT

The present disclosure features inflatable kayaks that have a non-planar hull bottom surface. The kayaks may include an inflatable, tubular body having a bow, a stern and a mid-section, wherein opposed side tubes of the midsection define an open central seating area having a predetermined width when the tubular body is inflated; and a hull bottom fabric joined to a lower surface of the body outside of a periphery of the seating area, the hull bottom fabric having a width that is greater than the width of the central seating area such that the hull bottom fabric is not tensioned between the side tubes, and the hull bottom fabric being joined to the side tubes outboard of a vertical center line of the side tubes.

20 Claims, 8 Drawing Sheets

INFLATABLE KAYAKS WITH NON-PLANAR HULLS

RELATED APPLICATION

This application claims priority to U.S. Patent Application Ser. No. 63/330,620, filed Apr. 13, 2022, the entire contents of which are hereby incorporated by reference.

BACKGROUND

Rigid kayaks, particularly whitewater kayaks and sea kayaks, often have hull shapes that have a cross-wise cross-sectional shape that is designed to impart secondary stability and/or the ability to edge or roll the kayak. For example, these kayaks may have displacement hull shapes, e.g., rounded or V-shaped hulls. Some whitewater kayaks have planing hull shapes with a flat bottom to skim on the water surface and side walls having beveled edges that are designed to allow the user to tilt the kayak on edge. The secondary stability when a kayak is on edge increases its maneuverability and performance in whitewater.

In contrast, all-fabric inflatable rafts and kayaks (inflatable boats that lack any rigid frame or floor) have a flat bottom that abruptly transitions to tubular sidewalls, formed by tensioning a fabric floor between side tubes. This configuration is shown diagrammatically in FIG. 1, in which a floor 10 is tensioned between side tubes 12 and is attached to the tubes at or inboard of the vertical centerline C of each tube. As a result, the bottom surface 14 of the hull is planar, and is at the same height as the bottom surfaces of the side tubes. This flat profile provides good primary stability but does not provide secondary stability. Because as soon as the user tips the boat the user's weight is balanced on a small area of the rounded surface of the tube, this profile does not allow the user to easily edge or roll the boat, as is desirable for performance handling of a kayak. In some all-fabric inflatable rafts and kayaks, the fabric floor may be inflatable itself or have an inflatable insert to create additional floatation in the floor to allow the watercraft to self-bail. However, in such kayaks inflation of the floor does not change the hull bottom shape, which remains planar.

SUMMARY

The present disclosure features inflatable kayaks that have a non-planar hull, i.e., the bottom surface of the hull of the inflated kayak is non-planar. The non-planar shape of the floor of the inflated kayak provides the kayak with secondary stability and allows the user to edge and roll the kayak as will be discussed below.

In one aspect, the disclosure features an inflatable kayak comprising (a) an inflatable, tubular body having a bow, a stern and a midsection, wherein opposed side tubes of the midsection define an open central seating area having a predetermined width when the tubular body is inflated; and (b) a hull bottom fabric joined to a lower surface of the body outside of a periphery of the seating area, the hull bottom fabric having a width that is greater than the width of the central seating area such that the hull bottom fabric is not tensioned between the side tubes, and the hull bottom fabric being joined to the side tubes outboard of a vertical center line of the side tubes.

Some implementations include one or more of the following features. The kayak may further include a floor insert configured to be positioned in the central seating area and press downwardly against an upper surface of the hull bottom fabric. The floor insert may be inflatable. The floor insert may be removable, and when the floor insert and tubular body are inflated an edge of the floor insert may be captured between a lower surface of the side tubes and an upper surface of the hull bottom fabric. The floor insert may include baffles that run parallel to a longitudinal axis of the kayak and may also include baffles that run perpendicular to the longitudinal axis, positioned at one end of the floor insert. The floor insert may include a non-inflatable portion configured to be positioned below a user's feet. The kayak may be configured so that, in use, an upper surface of the floor insert is exposed for contact by a user seated in the kayak.

The hull bottom fabric may joined at an attachment line that is at least 20 degrees outboard of the vertical center line. The hull bottom fabric may be separate from the body outboard of the vertical center line and inboard of the attachment line. This separation may provide a space for insertion of an edge of the floor insert between a lower surface the side tubes and an upper surface of the hull bottom fabric. The hull bottom fabric may be joined to the side tubes at an attachment line that is from about 25 to 40 degrees outboard of the center line. The hull bottom fabric may be adhered to the bow and stern of the tubular body.

The hull bottom fabric and floor insert may define a non-planar hull bottom surface that includes angled side surfaces and a planar central surface when viewed in transverse cross-section. The side surfaces may be disposed at an angle of from about 25 to 35 degrees relative to the central surface. At a lowest point along the length of the kayak the central surface is at least about 5 cm below a lowest point of the side tubes during use of the kayak.

In another aspect, the invention features a method of using an inflatable kayak, the method comprising (i) providing a kayak comprising (a) an inflatable, tubular body having a bow, a stern and a midsection, wherein opposed side tubes of the midsection define an open central seating area having a predetermined width when the tubular body is inflated; and (b) a hull bottom fabric joined to a lower surface of the body outside of a periphery of the seating area, the hull bottom fabric having a width that is greater than the width of the central seating area such that the hull bottom fabric is not tensioned between the side tubes, and the hull bottom fabric being joined to the side tubes outboard of a vertical center line of the side tubes; (ii) inflating the tubular body; and (iii) supporting the un-tensioned hull bottom fabric to provide a hull bottom surface having a predetermined shape.

Some implementations include one or more of the following features. The method further includes inserting an inflated floor insert into the open central seating area such that the floor insert presses against and supports the un-tensioned hull bottom fabric. The method further includes inserting an edge of the floor insert between a lower surface of the side tubes and an upper surface of the hull bottom fabric. The method further includes a user sitting on a surface of the floor insert. The method further includes the user tilting the kayak sideways onto an angled hull bottom surface provided by the hull bottom fabric and floor insert, e.g., while the user is paddling the kayak in a body of water.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

DETAILED DESCRIPTION

Figure 2:
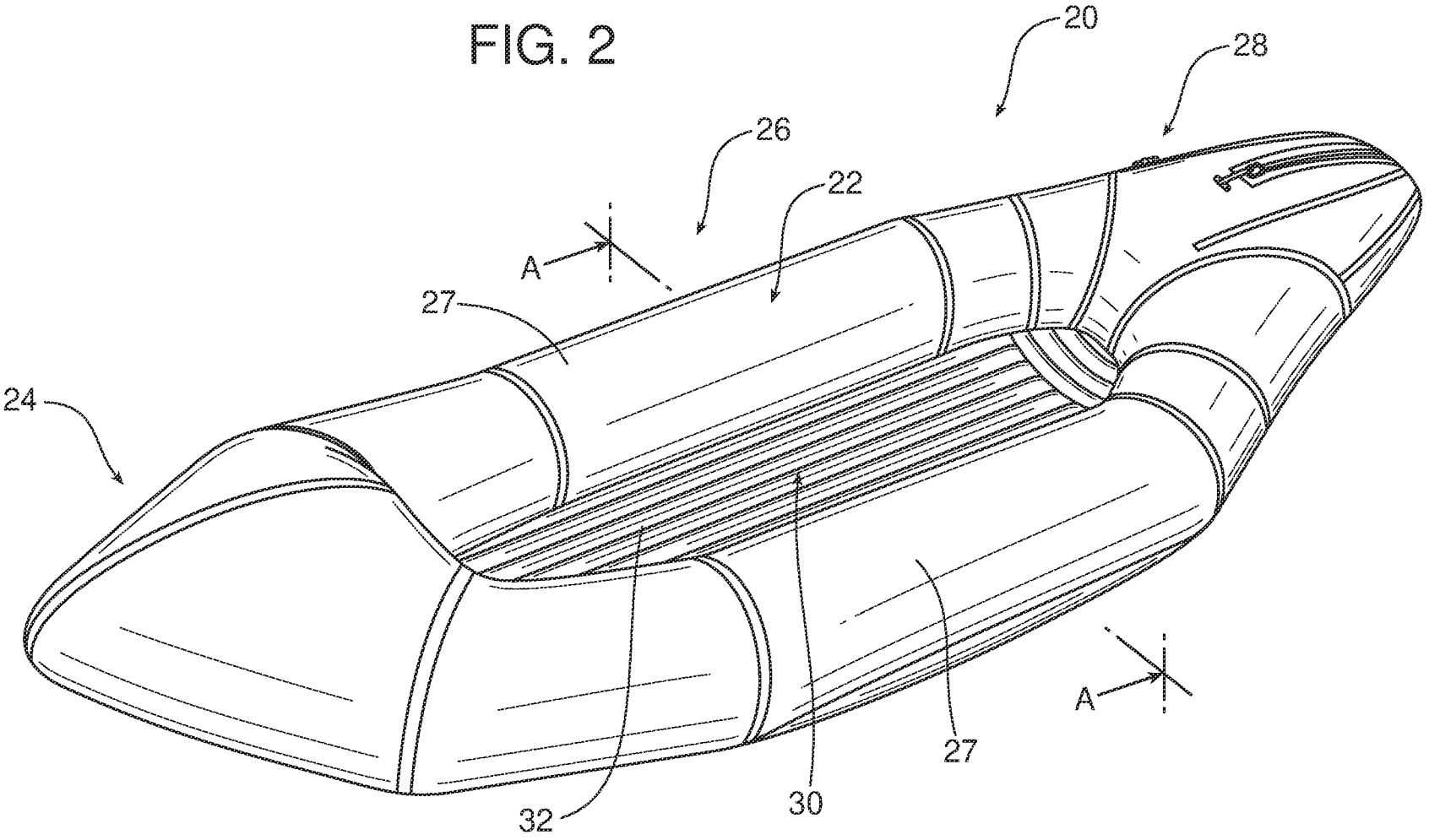
FIG. 2 is a perspective view of an inflated kayak according to one implementation.
Figure 2A:
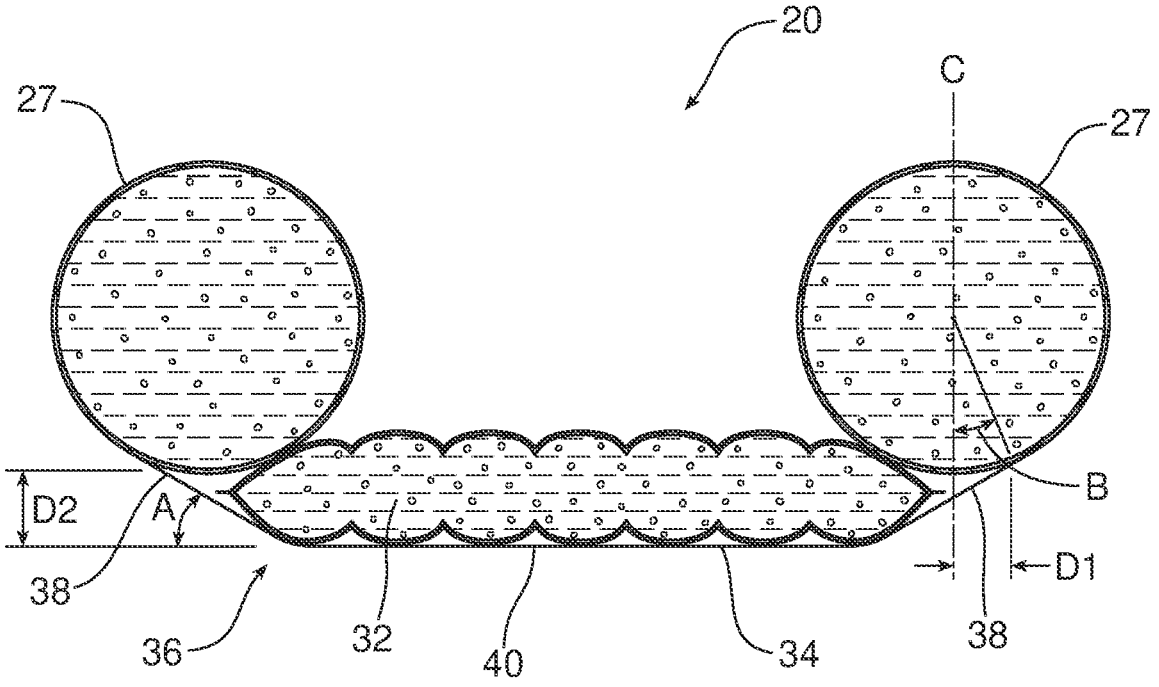
FIG. 2A is a cross-sectional view of the kayak shown in FIG. 2, taken along line A-A.

Referring to FIGS. 2-2A, an inflatable kayak 20 according to a first implementation has an inflatable tubular body 22 that includes a bow 24, a midsection 26 consisting of side tubes 27, and a stern 28. The tubular body defines an open central area 30 in which the user sits, and which is spanned by a floor insert 32 that is configured to support the user. The floor insert 32 is supported by and presses down on a hull bottom fabric 34 (FIG. 2A) that, with the floor insert, defines the shape of the bottom of the kayak's hull (which together with the outer surfaces of the side tubes defines the overall hull shape) as will be discussed in detail below.

Figure 1:
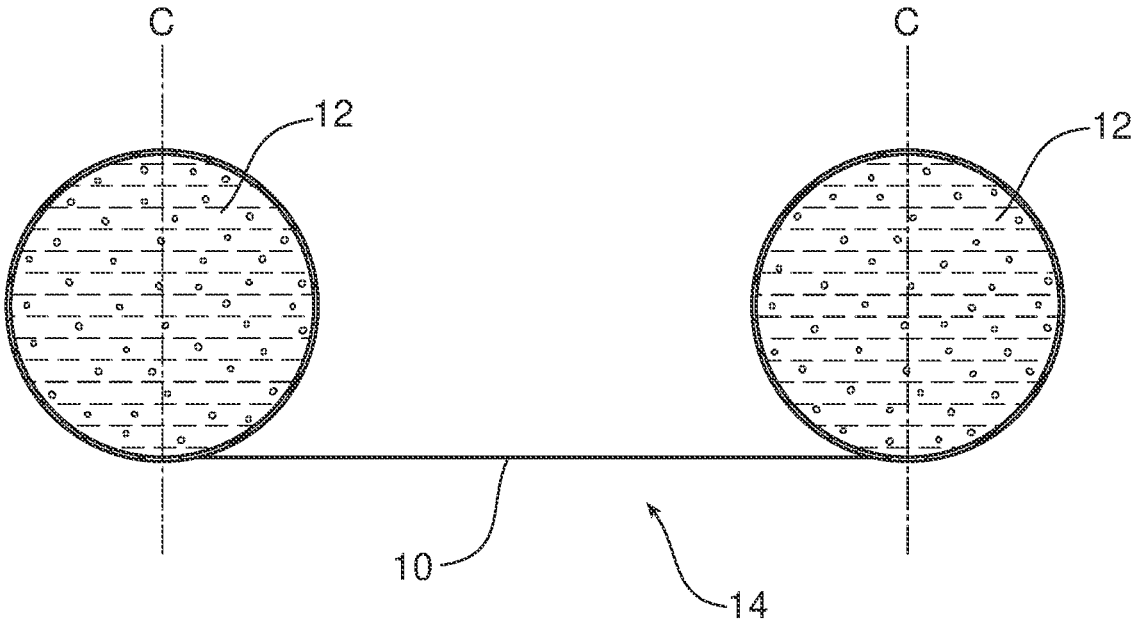
FIG. 1 PRIOR ART
FIG. 1 is a diagrammatic view of the hull shape of an inflated prior art inflatable kayak.

As discussed above and shown in FIG. 1, in conventional inflatable all-fabric kayaks, a piece of fabric is attached to the tubular body at or near the vertical centerline of the side tubes and tensioned across the central area, resulting in a flat-bottomed boat. In contrast, as shown in FIG. 2C the hull bottom fabric 34 is not tensioned between the side tubes, but instead is wider than the span between the inflated side tubes (central area 30) and thus hangs loosely below the side tubes when the floor insert 32 is not in place. Also, as shown in FIG. 2A, the hull bottom fabric is attached to the side tubes outboard of the centerline C at an angle of at least 20 degrees, for example from about 20 to 50 degrees (angle B, FIG. 2A). At angles less than 20 degrees there is not much surface for edging the kayak, while at angles greater than 50 degrees it tends to be difficult to cut the floor to shape so it attaches to the boat cleanly. In some implementations angle B may be from about 25 to 40 degrees or from about 28 to 32 degrees. The linear distance from the centerline C (D1, FIG. 2A) will vary depending on the tube diameter. For example, with a 240 mm diameter side tube, D1 may be from about 65 to 75 mm.

Figure 2B:
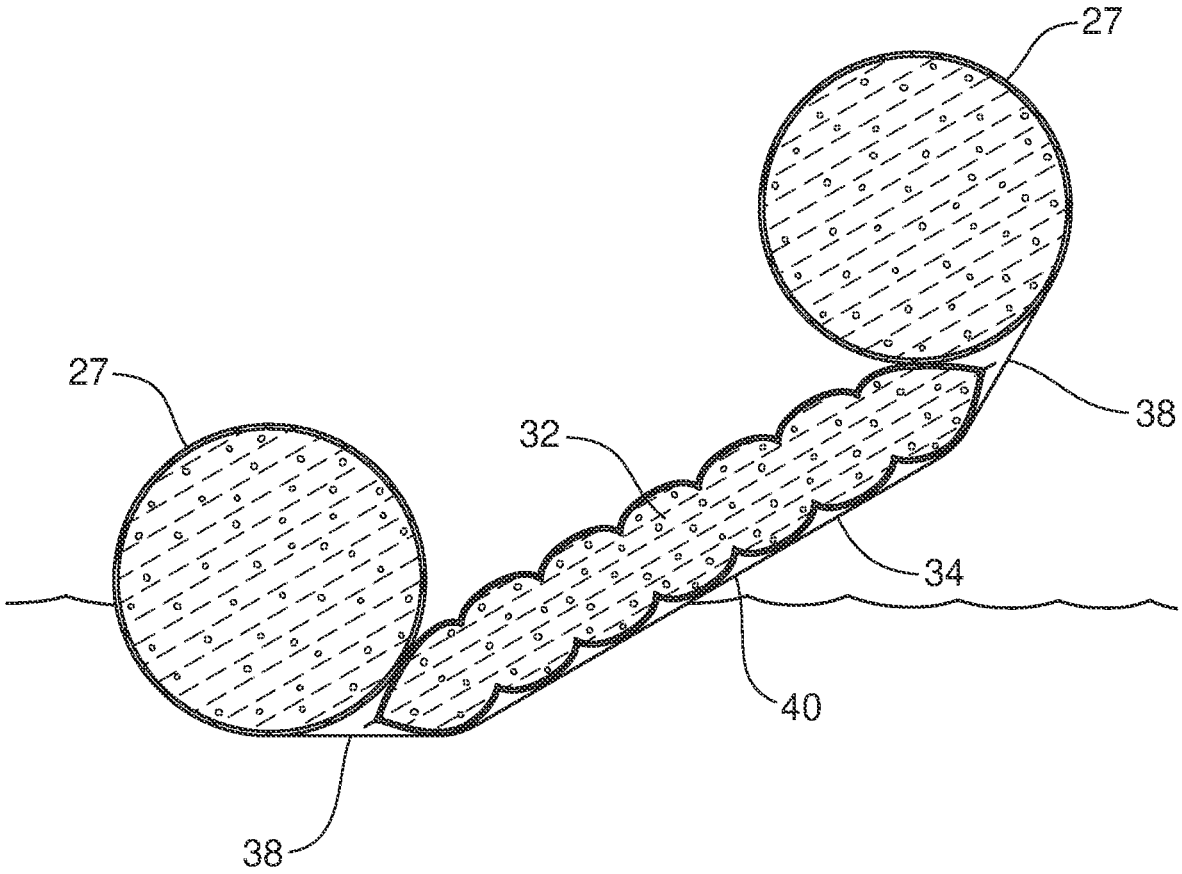
FIG. 2B shows the kayak shown in FIGS. 2-2A tilted up on edge in the water.
Figure 2C:
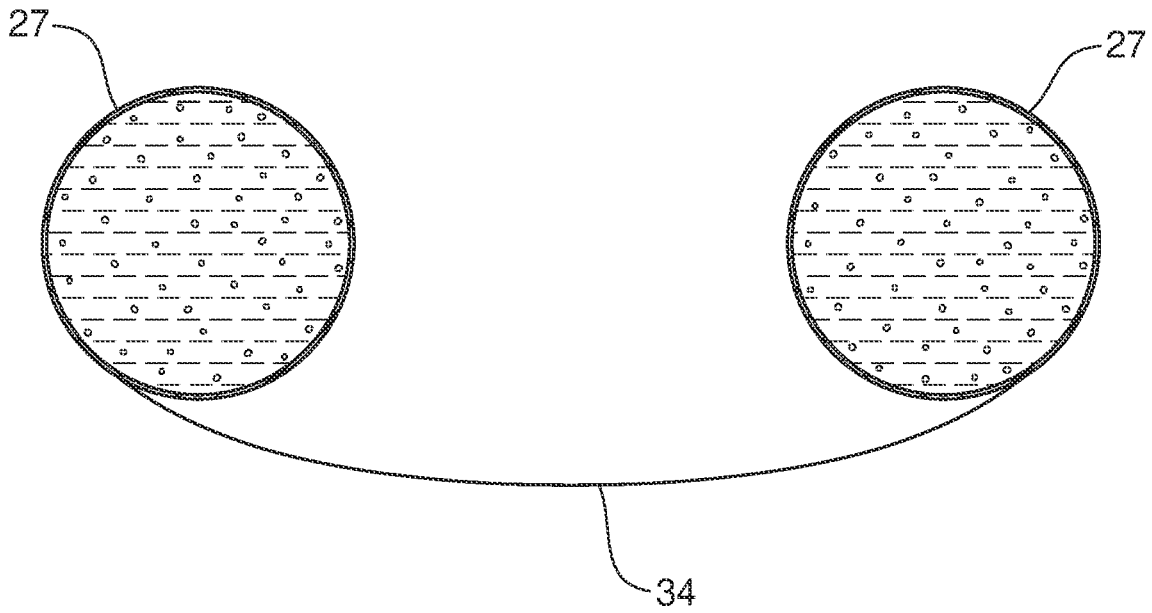
FIG. 2C is a cross-sectional view similar to FIG. 2A but with the floor insert removed.
Figure 3:
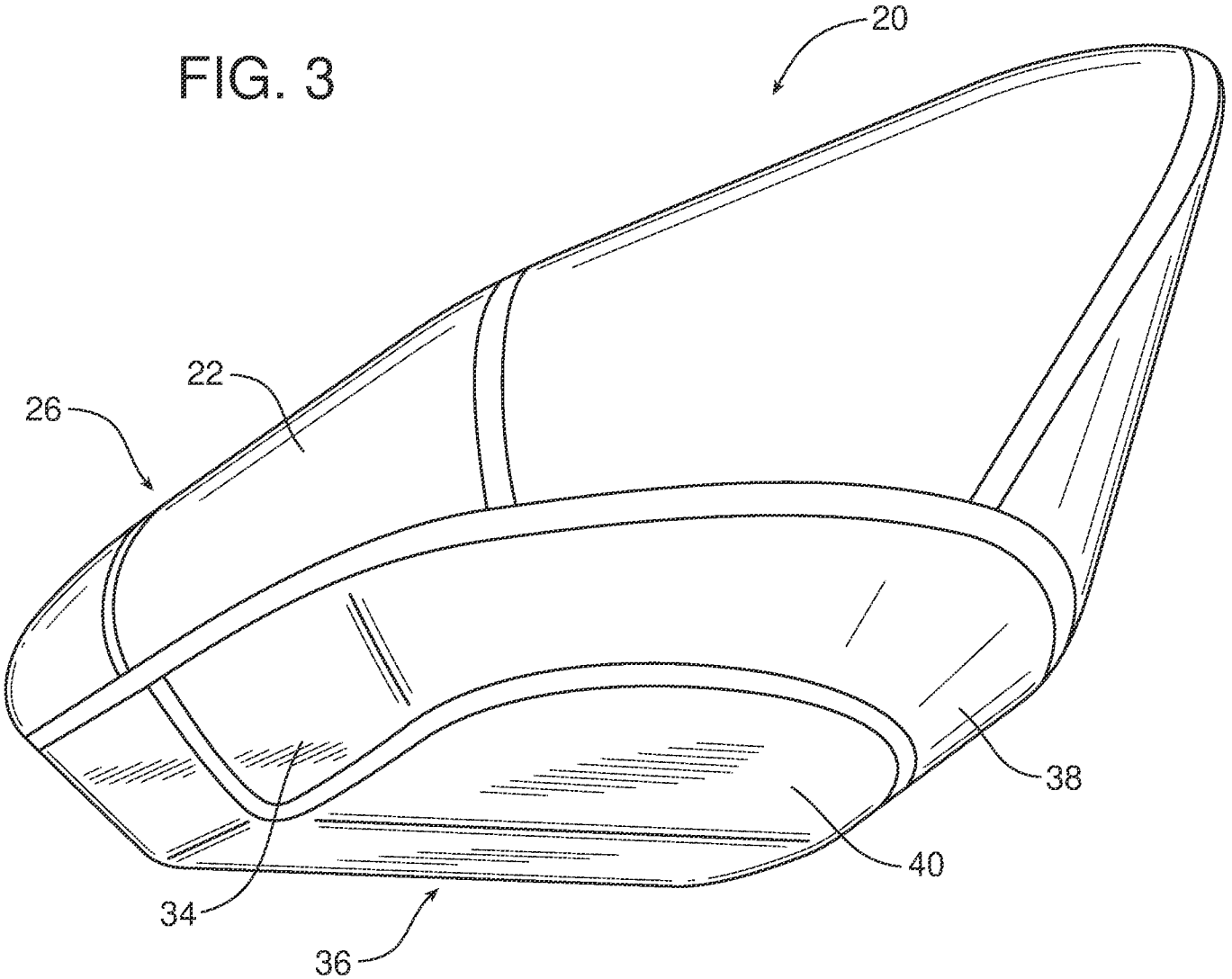
FIG. 3 is a perspective view of the kayak shown in FIG. 2, taken from below.

When the floor insert 32 is in place and inflated, as shown in FIGS. 2A, 2B and 3, the hull bottom fabric 34 and floor insert 32 together provide a hull bottom surface 36 that includes angled portions 38 and a flat central portion 40. As can be seen in FIG. 3, this shaped hull surface is positioned in the midsection 26 of the kayak, where the user's weight will be centered during use. Although the central portion 40 is generally planar, the overall shape of the hull bottom surface is non-planar due to the presence of the angled portions 38.

The flat central portion 40 is positioned below the bottom surfaces of the side tubes, e.g., at the lowest point of the central portion 40 along the length of the kayak the distance D2 (FIG. 2A) can be at least 5 cm, in some cases at least 7 cm, or even 10 cm or more, enhancing the secondary stability of the kayak. This distance is related to the tube diameter and angle A (FIG. 2A) of the angled portions 38 and will generally increase as these parameters increase. The depth of the hull will also depend on the desired handling characteristics of the kayak, for example how much primary and secondary stability are present, with a wider central portion favoring primary stability and a narrower central portion providing greater secondary stability. This extension of the hull below the side tubes is deepest in the midsection 26 of the kayak, tapering to be shallower closer to the bow 24 and stern 28. At the bow and stern, the hull bottom fabric is adhered directly to the tubular body and does not extend below the tubular body.

The angled portions 38 provide a large, stable flat area that can be edged by a user, as shown in FIG. 2B. The angle between the angled portions and flat central portion (angle A, FIG. 2A) can be, for example, from about 20 to 45 degrees, e.g., from about 25 to 35 degrees. This angle is provided by the thickness of the floor insert, the diameter of the side tube, and the distance D1 between the centerlines C of the side tubes and the attachment location of the hull bottom fabric. Accordingly, using these variables the angle of the angled surfaces and the width of the central portion can be selected to provide desired performance and handling characteristics.

The distance D1 of the attachment locations of the hull bottom fabric also provides a gap between a lower surface of the side tubes and an upper surface of the hull bottom fabric. As shown in FIGS. 2A-2B, when the tubular body and the floor insert are inflated the edges of the floor insert are tightly sandwiched between these surfaces. This engagement serves to hold the floor insert securely in place during use, and to press the floor insert downward against the upper surface of the hull bottom fabric creating the desired hull shape. This also tends to prevent any water that enters the space between the floor insert and hull bottom fabric from being trapped.

Because the floor insert is held in place by the side tubes, there is no need for other attachments that could increase the weight and/or complexity of manufacture of the kayak.

Figure 4:
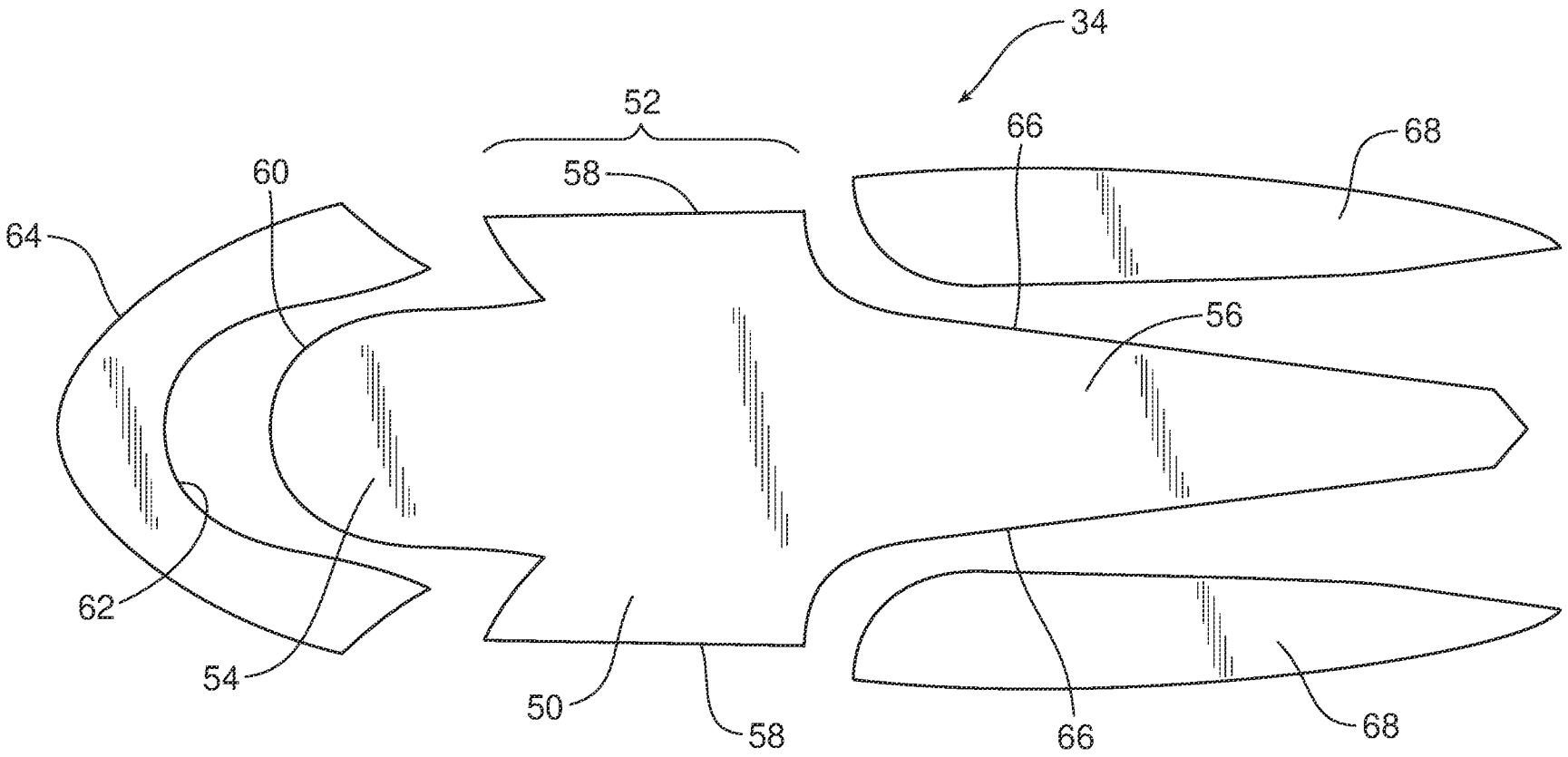
FIG. 4 is a top view of the pieces of fabric used to assemble the floor of the kayak shown in FIG. 3.

Referring now to FIG. 4, to provide the loose portion of the hull bottom fabric shown in FIG. 2C, while conforming the hull bottom fabric to the shape of the bow and stern (to which it is completely adhered) it is generally necessary to join several pieces of fabric. Main portion 50 includes a central area 52, a bow region 54 and a stern region 56. The central area 52 has generally straight edges 58 that are joined directly to the side tubes 27 of the tubular body. The edges are joined to the side tubes by relatively narrow lines of attachment positioned outboard of the centerline C of the side tubes as discussed above. The area between edges 58 is the area of the hull bottom fabric that extends below the side tubes and provides the hull shape and is configured to be positioned where the user sits during use of the kayak. The bow region 54 of the main portion 50 includes a generally U-shaped edge 60 that is joined to a correspondingly shaped edge 62 of bow portion 64. The joining of the corresponding U-shaped edges results in a three-dimensional shape that corresponds to the shape of the underside of the bow 24 of the tubular body, allowing the hull bottom fabric to be smoothly adhered to the underside of bow 24. Stern region 56 of the main portion 50 includes edges 66 that are curved where they depart from the central area and then taper towards each other to terminate at a narrow end of the stern region. Stern portions 68 are correspondingly shaped, so that joining of edges 66 and 68 results in a three-dimensional shape that corresponds to that of the underside of the stern 28 of the tubular body. The hull bottom fabric in the stern region is also fully adhered to the stern. Thus, the bow and stern of the kayak present a sleek, hydrodynamic profile that cuts through the water efficiently, while the area below the user's weight has the extended hull profile discussed above to facilitate edging of the kayak and provide secondary stability.

Figure 5:
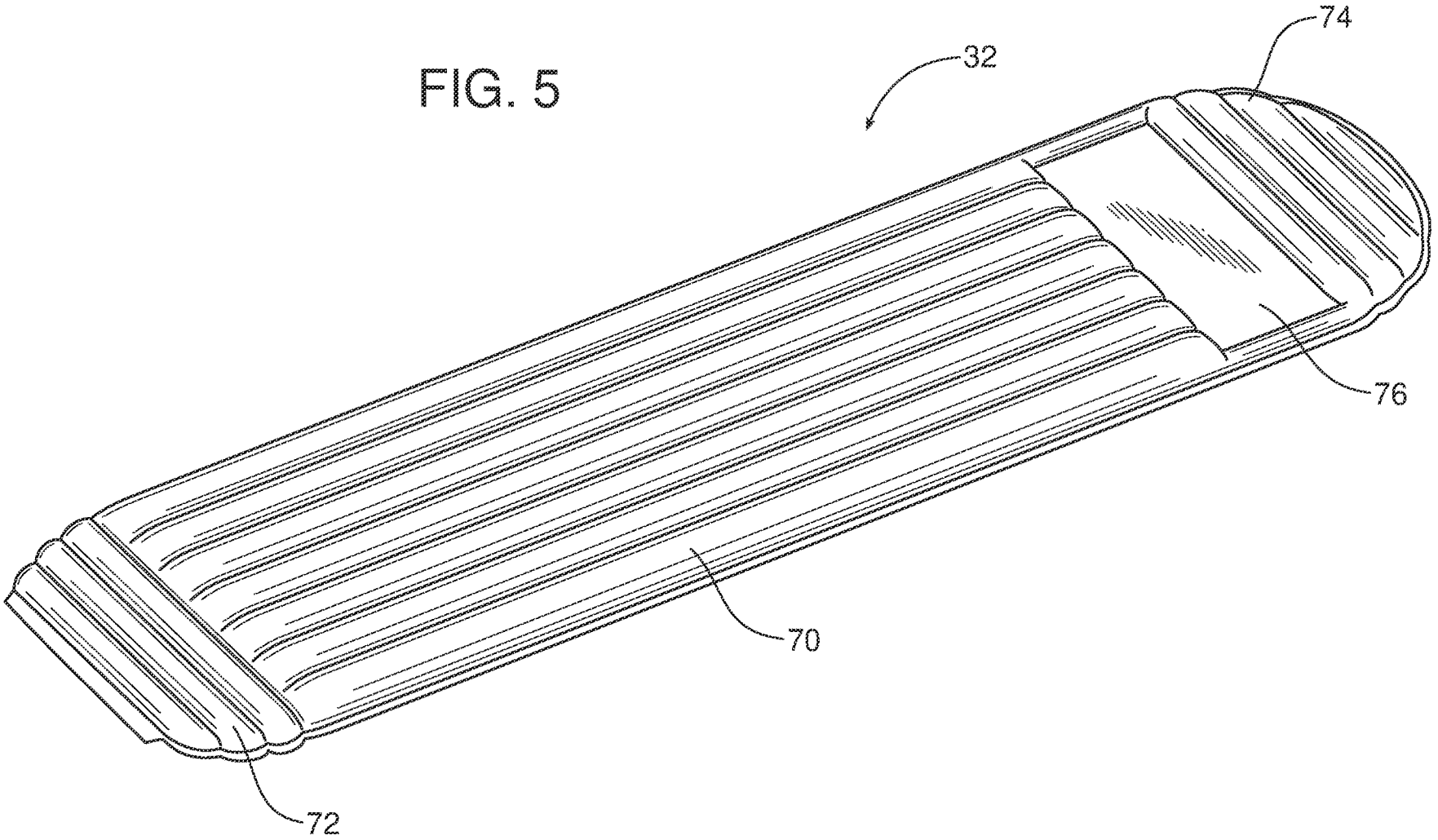
FIG. 5 is a perspective view of the floor insert used in the kayak of FIG. 2.

The floor insert is shown in detail in FIG. 5. In the implementation shown, the floor insert 32 includes a central region of longitudinally extending baffles 70, a first area of transverse baffles 72 that is positioned at the bow end of the central opening, and a second area of transverse baffles 74 that is positioned at the stern end of the central opening. The longitudinal baffles provide the floor insert with rigidity, helping to support the user's weight in the kayak without sagging and provide structure to the hull bottom fabric. The transverse baffles allow the ends of the floor insert to conform to the shape of the bow and stern. The floor insert also includes a non-inflatable area 76 that can serve as an area for the user to brace his or her feet or can receive a separate (not shown) foot brace.

OTHER EMBODIMENTS

A number of embodiments have been described. Nevertheless, it will be understood that various modifications may be made without departing from the spirit and scope of the disclosure.

For example, the floor insert may have a different baffle configuration, e.g., to provide a different hull profile or other ergonomic features to the seating area of the kayak. The floor insert may also be permanently attached to the kayak rather than removable.

Moreover, the fabric pattern used to form the "three-dimensional" hull bottom fabric can have any suitable configuration to produce a desired hull shape and/or to confirm to a tubular body having a different bow and/or stern shape.

In some cases, the floor insert may be omitted, and the loose hull bottom fabric may be supported in the desired hull shape in other ways. For example, a tensioned floor may be provided above the hull bottom fabric, and the space between the tensioned floor and the hull bottom fabric may be inflated.

Accordingly, other embodiments are within the scope of the following claims.

What is claimed is:

1. An inflatable kayak comprising:

a tubular body that is inflatable, the tubular body having a bow, a stern and a midsection, the midsection comprising a pair of side tubes that together define an open central seating area having a predetermined width when the tubular body is inflated; and a hull bottom fabric joined to a lower surface of the tubular body outside of a periphery of the seating area, the hull bottom fabric having a width that is greater than the width of the central seating area such that the hull bottom fabric is not tensioned between the side tubes, and the hull bottom fabric being joined to the side tubes outboard of a vertical center line of the side tubes.

2. The kayak of claim 1 further comprising a floor insert configured to be positioned in the central seating area and press downwardly against an upper surface of the hull bottom fabric.

3. The kayak of claim 2 wherein the floor insert is inflatable.

4. The kayak of claim 3 wherein the floor insert is removable, and when the floor insert and tubular body are inflated an edge of the floor insert is captured between a lower surface of the side tubes and an upper surface of the hull bottom fabric.

5. The kayak of claim 1 wherein the hull bottom fabric is joined at an attachment line that is at least 20 degrees outboard of the vertical center line.

6. The kayak of claim 5 wherein the hull bottom fabric is separate from the tubular body outboard of the vertical center line and inboard of the attachment line.

7. The kayak of claim 5 wherein the hull bottom fabric is joined at an attachment line that is from about 25 to 40 degrees outboard of the center line.

8. The kayak of claim 1 wherein the hull bottom fabric is adhered to the bow and stern of the tubular body.

9. The kayak of claim 2 wherein the hull bottom fabric and floor insert define a non-planar hull bottom surface that includes angled side surfaces and a planar central surface when viewed in transverse cross-section.

10. The kayak of claim 9 wherein the side surfaces are disposed at an angle of from about 25 to 35 degrees relative to the central surface.

11. The kayak of claim 9 wherein at a lowest point along the length of the kayak the central surface is at least about 5 cm below a lowest point of the side tubes during use of the kayak.

12. The kayak of claim 3 wherein the floor insert includes baffles that run parallel to a longitudinal axis of the kayak.

13. The kayak of claim 12 wherein the floor insert further includes baffles that run perpendicular to the longitudinal axis, positioned at one end of the floor insert.

14. The kayak of claim 13 wherein the floor insert further includes a non-inflatable portion configured to be positioned below a user's feet.

15. The kayak of claim 2 wherein in use an upper surface of the floor insert is exposed for contact by a user seated in the kayak.

16. A method of using an inflatable kayak, the method comprising:

providing a kayak comprising (a) a tubular body that is inflatable, the tubular body having a bow, a stern and a midsection, the midsection comprising a pair of side tubes that together define an open central seating area having a predetermined width when the tubular body is inflated; and (b) a hull bottom fabric joined to a lower surface of the tubular body outside of a periphery of the seating area, the hull bottom fabric having a width that is greater than the width of the central seating area such that the hull bottom fabric is not tensioned between the side tubes, and the hull bottom fabric being joined to the side tubes outboard of a vertical center line of the side tubes;

inflating the tubular body; and supporting the un-tensioned hull bottom fabric to provide a hull bottom surface having a predetermined shape.

17. The method of claim 16 further comprising inserting an inflated floor insert into the open central seating area such that the floor insert presses against and supports the un-tensioned hull bottom fabric.

18. The method of claim 17 further comprising inserting an edge of the floor insert between a lower surface of the side tubes and an upper surface of the hull bottom fabric.

19. The method of claim 17 further comprising sitting on a surface of the floor insert.

20. The method of claim 19 further comprising tilting the kayak sideways onto an angled hull bottom surface provided by the hull bottom fabric and floor insert.

* * * * *